US006404389B1

(12) United States Patent
Franey et al.

(10) Patent No.: US 6,404,389 B1
(45) Date of Patent: Jun. 11, 2002

(54) PATCH ANTENNA

(75) Inventors: John Philip Franey, Bridgewater; Keith V. Guinn, Basking Ridge; Louis Thomas Manzione, Summit; Ming-Ju Tsai, Livingston, all of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/425,368

(22) Filed: Oct. 22, 1999

(51) Int. Cl.[7] ..... H01Q 1/38

(52) U.S. Cl. ..... 343/700 MS; 343/872

(58) Field of Search ..... 343/700 MS, 818, 343/872, 873

(56) References Cited

U.S. PATENT DOCUMENTS

| | | | | | |
|---|---|---|---|---|---|
| 5,321,411 | A | * | 6/1994 | Tsukamoto et al. .. | 343/700 MS |
| 5,892,661 | A | * | 4/1999 | Stafford ..... | 361/737 |
| 5,896,107 | A | * | 4/1999 | Huynh ..... | 343/700 MS |
| 5,903,239 | A | * | 5/1999 | Takahashi et al. ... | 343/700 MS |
| 5,926,136 | A | * | 7/1999 | Ohtsuka et al. ..... | 343/700 MS |
| 5,977,710 | A | * | 11/1999 | Kuramoto et al. ... | 343/700 MS |
| 6,037,903 | A | * | 3/2000 | Lange et al. ..... | 343/700 MS |

* cited by examiner

*Primary Examiner*—Don Wong
*Assistant Examiner*—Trinh Vo Dinh
(74) *Attorney, Agent, or Firm*—Christopher N. Malvone

(57) ABSTRACT

An inexpensive, easy to assemble patch antenna is disclosed where unwanted polarizations in the transmitted RF energy are minimized. A feedboard, spacer and resonator are held in a compressed relationship by two halves of the antenna housing. The spacer is a thermo-formed sheet with semi-spherical spacers. The spacers have a height that provides the desired spacing between the feedboard and the resonator.

5 Claims, 5 Drawing Sheets

PATCH ANTENNA

CROSS REFERENCE TO RELATED INVENTION

This application is related to the following commonly assigned an concurrently filed U.S. patent applications entitled "Patch Antenna Using Non-Conductive Thermo Form Frame", Ser. No. 09/425,373, filed Oct. 22, 1999; and "Patch Antenna Using Non-Conductive Frame, Ser. No. 09/425,374, filed Oct. 22, 1999.

BACKGROUND OF THE INVENTION

1. Field of the Invention

The present invention relates to antennas; more particularly, patch antennas.

2. Description of the Prior Art

FIG. 1 illustrates an exploded view of a prior art patch antenna assembly. Front housing 10 and rear housing 12 form the outer surfaces of the antenna assembly. The two sections of the housing enclose multi-layered feedboard 14, resonators 16 and 18 and spacers 20. Spacers 20 are attached to front side 22 of feedboard 14 by screws 24. Screws 24 mate with threads on the inside of spacers 20 by passing through holes 26 in feedboard 14. Resonators 16 and 18 are attached to spacers 20 in a similar fashion. Screws 28 mate with threads on the inside of spacers 20 by passing through holes 30 in resonators 16 and 18. The spacers are chosen so that they provide a space of approximately 1/10 of a wavelength between feedboard 14 and resonators 16 and 18. The assembled feedboard, spacers and resonators are mounted inside of the enclosure formed by front housing 10 and rear housing 12. A signal to be transmitted by the antenna assembly is provided to conductor 40 of multi-layered feedboard 14. Conductor 40 is typically positioned on one layer of feedboard 14 such as on top layer 42. An insulating layer is typically provided between conductor 40 and a ground plane layer of feedboard 14. The ground plane layer normally has openings or slots 44 which allow the signal from conductor 40 to couple to resonators 16 and 18 so that the signal can be transmitted through front housing 10.

FIG. 2 provides a more detailed illustration of the assembled feedboard 14, spacers 20 and resonators 16 and 18. Screws 24 pass through holes in feedboard 14 to mate with the threaded inside portion of spacer 20. Similarly, screws 28 pass through holes in resonators 16 and 18 to mate with the threaded inside portion of spacers 20.

This prior art patch antenna assembly suffers from several shortcomings. The assembly is expensive to assemble because of the many individual parts such as eight spacers and 16 screws. The spacers are expensive to mass produce because they include threaded inner portions. Additionally, the holes made through resonators 16 and 18 to allow screws 28 to mate with spacers 20 create unwanted patterns in the radio frequency energy radiated by the antenna assembly. For example, if the antenna is being used for a horizontally polarized transmission, the holes introduce additional non-horizontal polarizations in the transmitted signal.

SUMMARY OF THE INVENTION

The present invention provides an inexpensive, easy to assemble patch antenna that does not introduce unwanted polarizations in the transmitted radio-frequency (RF) energy. A feedboard, spacer and resonator are held in a compressed relationship by two halves of the antenna housing. The spacer is a thermo-formed sheet with semi-spherical spacers. The spacers have a height that provides the desired spacing between the feedboard and the resonator.

In one embodiment, spherical spacers are positioned between the feedboard and resonator using an adhesive and then the feedboard, spacers and resonators are held in position by compression provided by the antenna housing assembly.

DETAILED DESCRIPTION OF THE INVENTION

Figure 3:
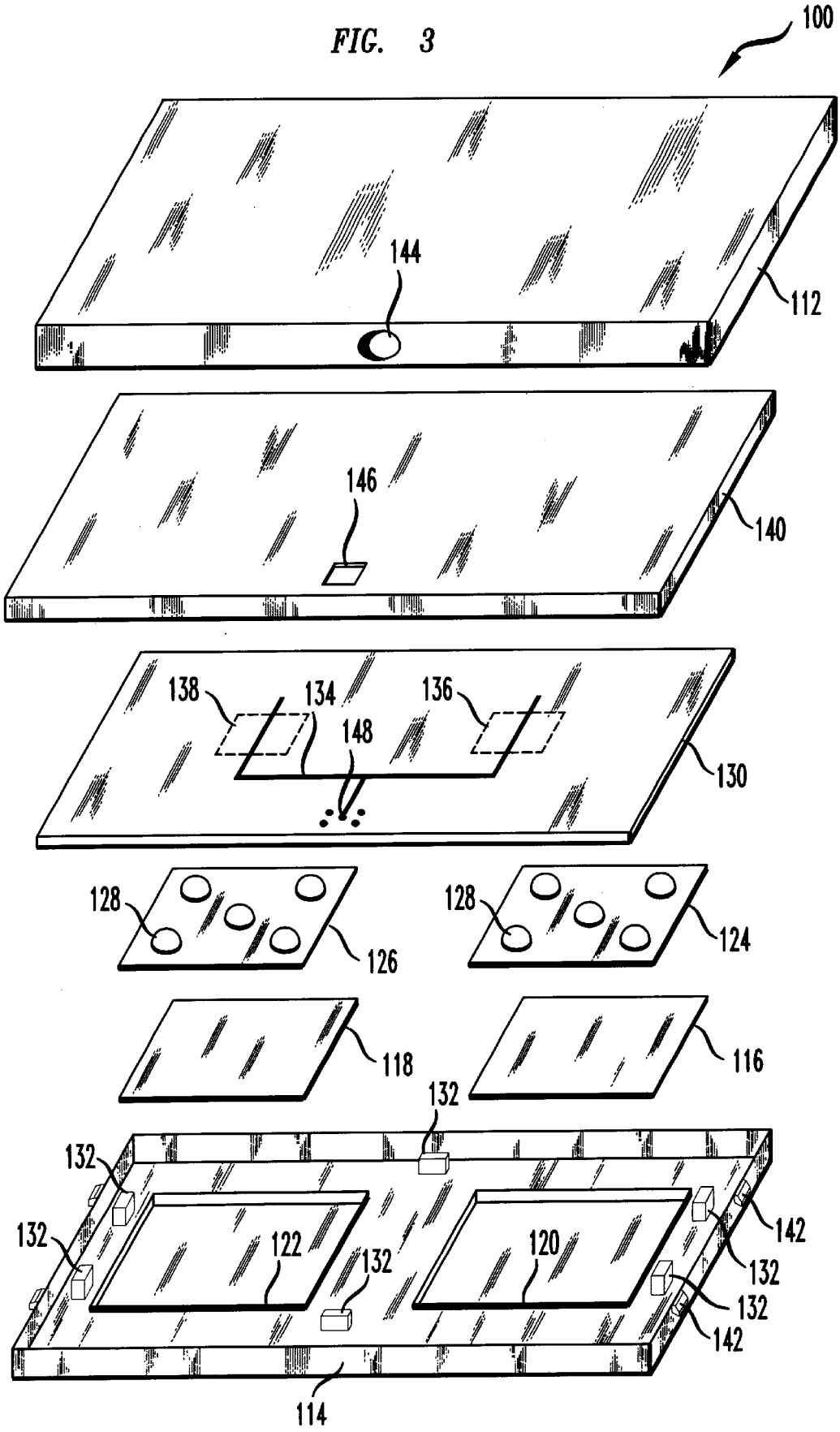
FIG. 3 illustrates an exploded view of a patch antenna assembly having semi-spherical spacers.

FIG. 3 illustrates patch antenna assembly 100. The assembly is enclosed by rear housing section 112 and front housing section 114. Resonator elements 116 and 118 are positioned in front housing section 114 by placing them within the outline of guide ribs 120 and 122. Semi-spherical spacer sheets 124 and 126 are then placed on top of resonators 116 and 118 respectively. It should be noted that ribs 120 and 122 are high enough to also aid in the positioning of spacer sheets 124 and 126. Spacer sheets 124 and 126 include semi-spherical spacers 128 which provide the desired spacing between the resonators and feedboard 130 (typically, 0.1 wavelengths of the signal to be transmitted). It should be noted that guide ribs 120 and 122 do not extend higher than semi-spherical spacers 128 so that ribs 120 and 122 do not interfere with the spacing provided by semi-spherical spacers 128. Multi-layer feedboard 130 is then positioned upon semi-spherical spacers 128. Feedboard 130 is positioned in front housing section 114 by positioning tabs 132. Multi-layer feedboard 130 is a board containing a ground plane, a plane containing conductor 134 and insulating layers on the top and bottom surfaces and between conductor 134 and the ground plane. Slots 136 and 138 in the ground plane permit a radio frequency (RF) signal on conductor 134 to couple to resonators 116 and 118 so that RF energy may be transmitted through front housing section 114. Metallic cover 140 is positioned over multi-layer feedboard 130 using guide tabs 132 to aid in positioning. Rear housing section 112 then mates with front housing section 114 and locks in place by interacting with locking tabs 142. Rear section 112 and metallic cover 140 contain openings 144 and 146 respectively which provide a passage through which a conductor can pass for attachment to point 148 on conductor 134.

Figure 1:
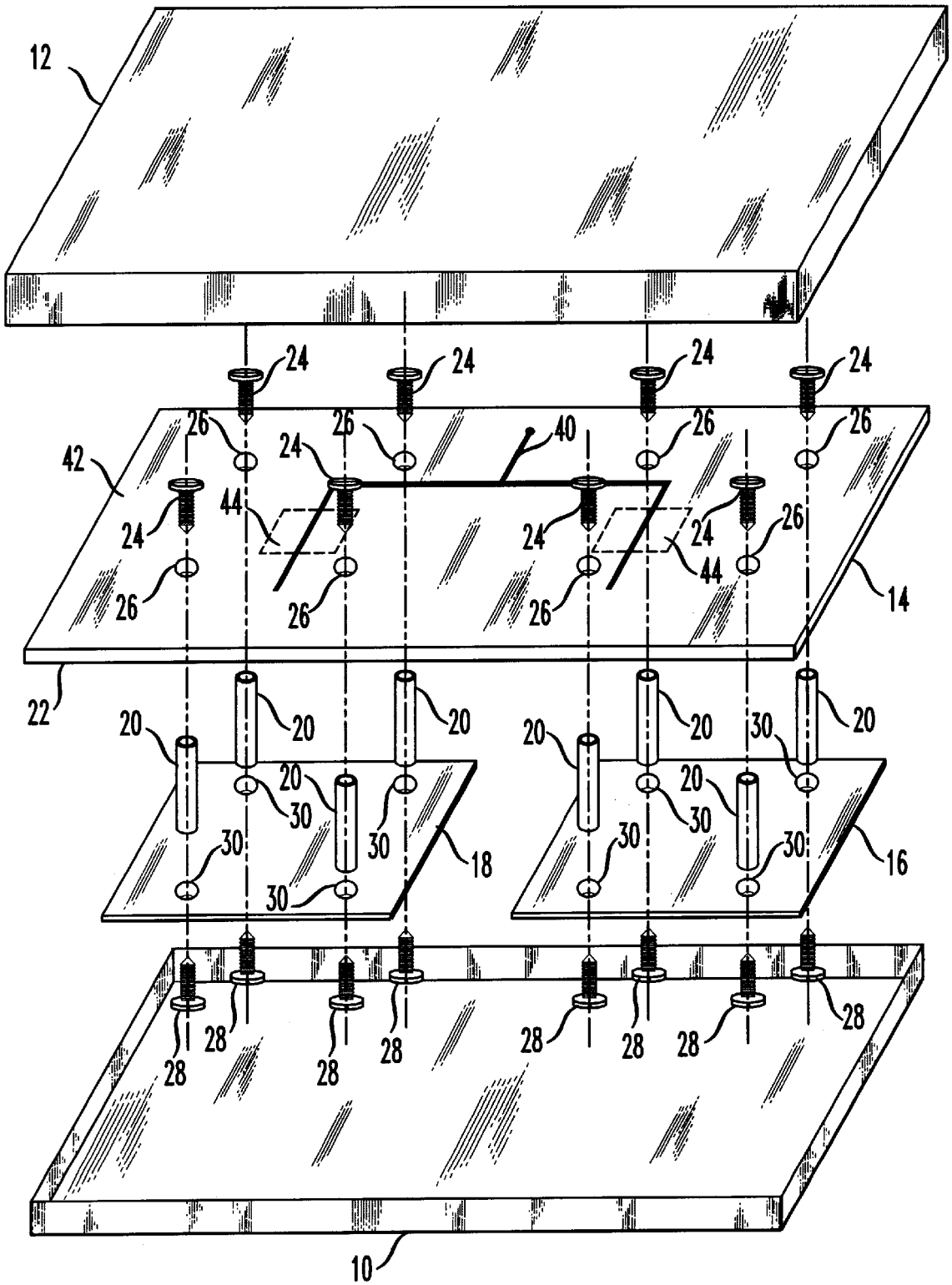
FIG. 1 (PRIOR ART)
FIG. 1 illustrates a prior art patch antenna assembly.
Figure 2:
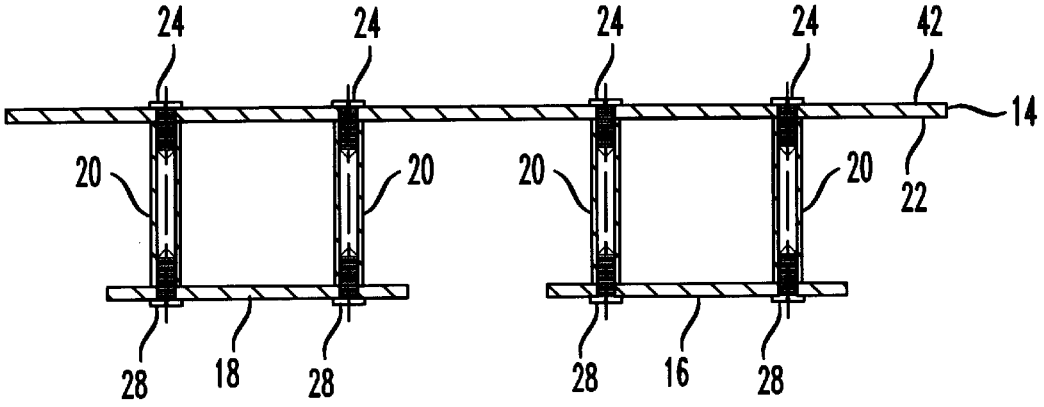
FIG. 2 (PRIOR ART)
FIG. 2 illustrates a prior art feedboard, spacer and resonator assembly.
Figure 4:
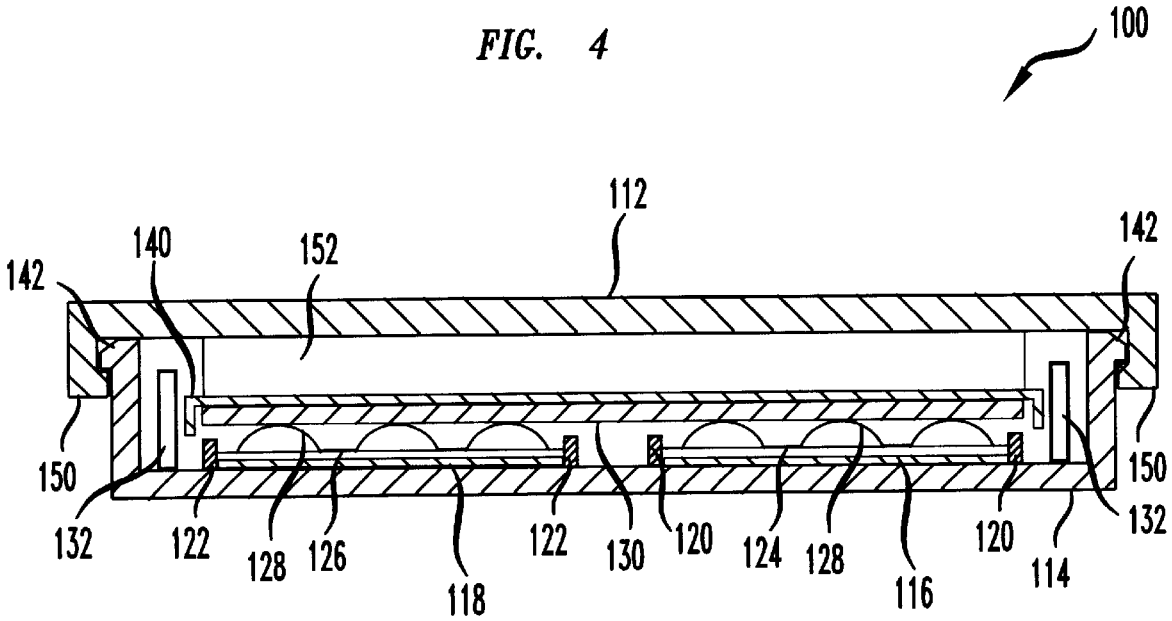
FIG. 4 illustrates a cross section of an assembled patch antenna system having semi-spherical spacers.

FIG. 4 illustrates a cross section of an assembled patch antenna having semi-spherical spacers. Front housing section 114 interlocks with rear housing section 112 by the action of tabs 142 and 150. Resonators 116 and 118 are positioned on the inside surface of front section 114 and are positioned between guide ribs 120 and 122. Each resonator typically measures 0.6 by 0.6 wavelengths of the signal to be transmitted. Spacer sheets 124 and 126 with semi-spherical projections are also positioned between guide ribs 120 and 122 respectively and on top of resonators 116 and 118. It should be noted that a slight space is shown between the spacer sheets and the patch elements. This spacing is only included to aid in illustrating the components of the assembly; in actuality, the spacers are held tightly against the patch elements by feedboard 130. Feedboard 130 is positioned on top of semi-spherical spacers 128 of spacer sheets 124 and 126. Positioning tabs 132 aid in correctly positioning feedboard 130 in front housing section 114. Metallic cover 140 is placed over feedboard 130 and tabs 132 provide guidance in positioning metallic cover 140. Rear cover 112 is pressed on to front section 114 so that tabs 142 and 150 interact to hold sections 114 and 112 together. Rear section 112 includes a series of parallel ribs 152 that form an interference fit of approximately 0.0005 mils or more between the ribs and metallic cover 140, feedboard 130, spacers 124 and 126, resonators 116 and 118, and the inside surface of front section 114. This results in a compression force of approximately 0.25 pounds being placed on the feedboard, spacers and resonators when the locking tabs of sections 112 and 114 engage. This compression force holds the feedboard, spacers and resonators in position.

Figure 5A:
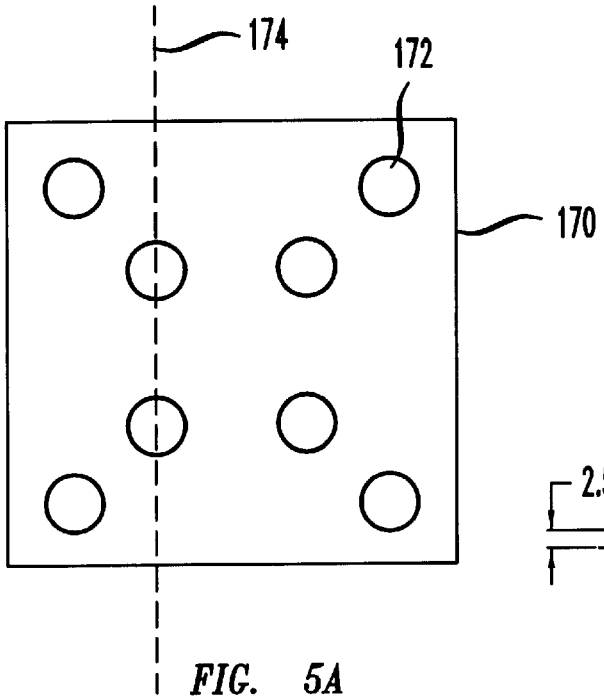
FIGS. 5A, 5B, and 5C illustrate a sheet having semi-spherical spacers.
Figure 5B:
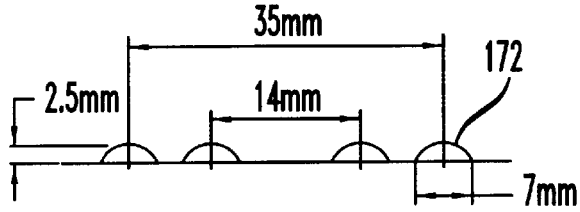
Figure 5C:
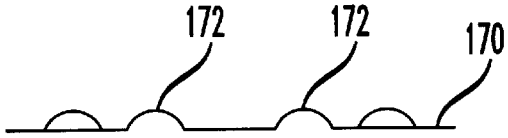

FIGS. 5A, 5B, and 5C illustrate a semi-spherical spacer sheet. Semi-spherical spacer sheet 170 includes semi-spherical spacers 172. Spacer sheet 170 is formed using a thermo-formed or heat pressed low radio frequency loss plastic that is on the order of 5 or 6 mils thick. Such materials include polycarbonate (PC) polymethyl methacrylate (PMMA) or polypropylene (PP) among others. PC is available from General Plastics, PMMA is from Rehm-Haas, whereas PP is from a number of plastic material vendors such as DuPont and Phillips 66. In one embodiment as illustrated in FIG. 5B, the semi-spherical spacers 172 are approximately 2.5 millimeters high for a 1.9 GHz antenna. For a frequency of x, 2 millimeters is suggested to provide a 1/10 wavelength spacing between the feedboard and resonator; however, an extra 0.5 millimeters may be included to provide for a small amount of compression in the semi-spherical spacers. In this embodiment the spacers are approximately 7 millimeters in diameter where the inner spacers are positioned 14 millimeters apart and the outer spacers are positioned 35 millimeters apart. It should be noted that sheet 170 essentially contains spacers or bubbles 172 that are formed in a normally flat sheet. For example, if a cross section of sheet 170 is taken along line 174 as illustrated in FIG. 5C, it can be seen that semi-spherical spacers 172 are essentially semi-spherical depressions formed in relatively flat sheet 170. This thermoforming process is relatively inexpensive and does not require special or expensive machine tools. For these reasons, the development time is relatively short.

Figure 6:
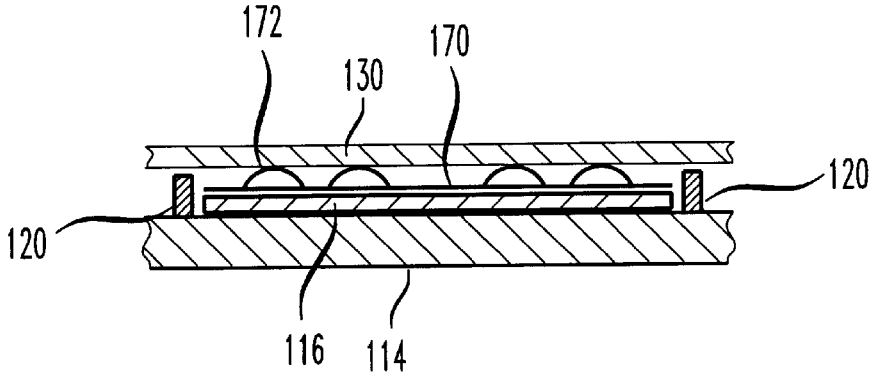
FIG. 6 illustrates the relationship between a feedboard, semi-spherical spacers, a resonator and the front portion of the antenna housing.

FIG. 6 illustrates a detailed view of the relationship between front housing section 114, resonator 116 or 118, a semi-spherical spacer sheet such as spacer sheet 170 and feedboard 130. Feedboard 130, spacer sheet 170, resonator 116 and front section 114 are held in a compressed relationship when the tabs of rear section 112 and front section 114 engage. It should be noted that the compressed relationship results in the spacing between feedboard 130 and resonator 116 being controlled by the height of semi-spherical spacers 172. The shape of semi-spherical spacers 172 provide a rigid structure that withstands the compression provided by housing sections 112 and 114.

Figure 7:
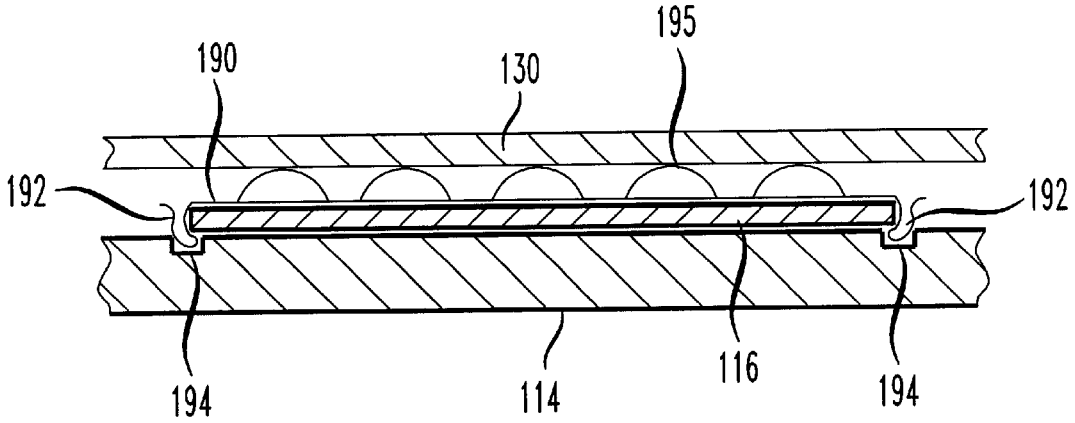
FIG. 7 illustrates a semi-spherical spacer with resonator locator tabs.

FIG. 7 illustrates semi-spherical spacer sheet 190 having locator tabs 192. Locator tabs 192 are used to position resonator 116 relative to spacer sheet 190. This provides the advantage of eliminating guides ribs 120 and 122. Additionally, slots 194 are included in front section 114 so that tabs 192 do not interfere with resonator 116 lying flat against the inside surface of front section 114. In addition, slots 194 aid in positioning spacer sheet 190 and resonator 116 on the inside surface of section 114. As described earlier, feedboard 130 is positioned on semi-spherical spacers 195 of spacer sheet 190. Feedboard 130, spacers 194 and resonator 116 are held in a compressed relationship by rear section 112 and front section 114 when interlocking tabs 142 and 150 are engaged.

Figure 8:
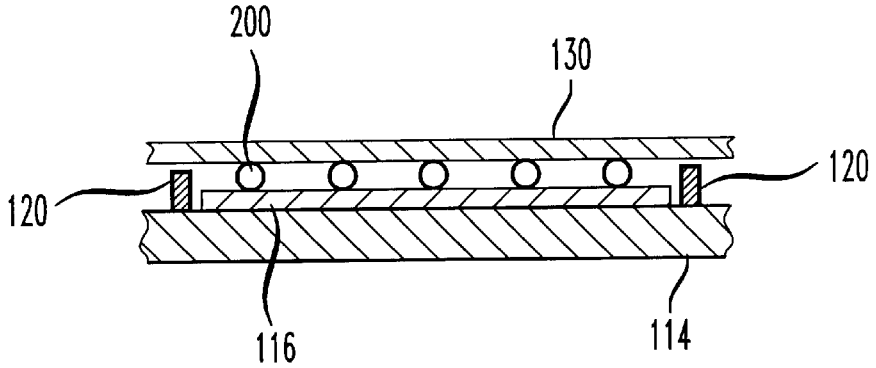
FIG. 8 illustrates spherical spacers.

FIG. 8 illustrates the use of spherical spacers 200. Resonator 116 is positioned on the inside surface of front housing section 114 using guide ribs 120. Spherical spacers 200 are then placed on the exposed surface of resonator 116. It may be desirable to use an adhesive to position spherical spacers 200 so that they do not move into undesired locations during assembly. It is also possible to include spherical spacers 200 in a liquid or foam that will hold the spheres in position during assembly. It should be noted that any adhesive, liquid or foam used to aid in the positioning of spheres 200 should be transparent or very low loss with respect to the RF signal being transmitted. Feedboard 130 is then placed on top of spherical spacers 200. Feedboard 130, spherical spacers 200 and resonator 116 are held in a compressed relationship when the locking tabs of rear section 112 and front section 114 are engaged.

The invention claimed is:

1. An antenna assembly, comprising:

a feedboard;

a resonator; and a spacer positioned between the feedboard and the resonator, the feedboard, the spacer and the resonator being held in compression; and a first housing section and a second housing section that join together to hold the feedboard, the spacer and the resonator in compression.

2. The antenna assembly of claim 1, wherein the spacer comprises a plurality of substantially spherical spacers.

3. The antenna assembly of claim 1, wherein the spacer comprises a plurality of substantially semi-spherical spacers.

4. The antenna assembly of claim 1, wherein the spacer comprises a sheet having a plurality of substantially semi-spherical spacers.

5. The antenna assembly of claim 4, wherein the spacer comprises resonator locator tabs.

* * * * *